US010160936B2

(12) United States Patent
Brown et al.

(10) Patent No.: US 10,160,936 B2
(45) **Date of Patent: *Dec. 25, 2018**

(54) LAUNDRY SCENT ADDITIVE

(71) Applicant: The Procter & Gamble Company, Cincinnati, OH (US)

(72) Inventors: Jodi Lee Brown, Cincinnati, OH (US); Kristin Marie Finley, Cincinnati, OH (US); Jaden Scott Zerhusen, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 174 days.

This patent is subject to a terminal disclaimer.

(21) Appl. No.: 15/247,115

(22) Filed: Aug. 25, 2016

(65) Prior Publication Data

US 2016/0362645 A1 Dec. 15, 2016

Related U.S. Application Data

(63) Continuation of application No. 14/108,833, filed on Dec. 17, 2013, now Pat. No. 9,453,188.

(60) Provisional application No. 61/739,820, filed on Dec. 20, 2012.

(51) Int. Cl.

| | |
|---|---|
| ***C11D 3/50*** | (2006.01) |
| ***C11D 3/37*** | (2006.01) |
| ***C11D 17/00*** | (2006.01) |
| ***C11D 3/20*** | (2006.01) |

(52) U.S. Cl.

CPC ..... *C11D 3/505* (2013.01); *C11D 3/2068* (2013.01); *C11D 3/3707* (2013.01); *C11D 3/50* (2013.01); *C11D 17/0052* (2013.01)

(58) Field of Classification Search

CPC ..... C11D 3/505; C11D 3/707; C11D 17/0052

See application file for complete search history.

(56) References Cited

U.S. PATENT DOCUMENTS

| | | | |
|---|---|---|---|
| 3,664,963 | A | 5/1972 | Pasin |
| 4,026,131 | A | 5/1977 | Dugger et al. |
| 4,176,079 | A | 11/1979 | Guerry et al. |
| 4,234,627 | A | 11/1980 | Schilling et al. |
| 4,253,842 | A | 3/1981 | Ehrlich |
| 4,264,466 | A | 4/1981 | Carleton et al. |
| 4,365,853 | A | 12/1982 | Ehlich |
| 4,416,791 | A | 11/1983 | Haq |
| 4,514,461 | A | 4/1985 | Woo |
| 4,557,852 | A | 12/1985 | Schulz et al. |

(Continued)

FOREIGN PATENT DOCUMENTS

| | | |
|---|---|---|
| CA | 2682636 | 1/2010 |
| DE | 2 263 940 | 7/1974 |

(Continued)

OTHER PUBLICATIONS

Non-Final Office Action for U.S. Appl. No. 14/108,833, dated Apr. 13, 2015, 12 pages.

(Continued)

*Primary Examiner* — John R Hardee
(74) *Attorney, Agent, or Firm* — Gary J. Foose

(57) ABSTRACT

A laundry scent additive having polyethylene glycol and perfume. The laundry scent additive enables consumers to control the amount of scent imparted to their laundry.

19 Claims, 2 Drawing Sheets

(56) References Cited

U.S. PATENT DOCUMENTS

| | | | |
|---|---|---|---|
| 4,765,916 | A | 8/1988 | Ogar, Jr. et al. |
| 4,882,220 | A | 11/1989 | Ono et al. |
| 4,898,781 | A | 2/1990 | Onouchi et al. |
| 5,004,556 | A | 4/1991 | Julemont et al. |
| 5,013,498 | A | 5/1991 | Frosechke |
| 5,160,654 | A | 11/1992 | Falou et al. |
| 5,328,684 | A | 7/1994 | Morgan et al. |
| 5,407,594 | A | 4/1995 | Fry et al. |
| 5,614,179 | A | 3/1997 | Murphy et al. |
| 5,733,272 | A | 3/1998 | Brunner et al. |
| 5,770,235 | A | 6/1998 | Baumann et al. |
| 5,817,614 | A | 10/1998 | Miracle et al. |
| 5,955,057 | A | 9/1999 | Maunder et al. |
| 6,022,845 | A | 2/2000 | Avila-Garcia et al. |
| 6,025,319 | A | 2/2000 | Surutzidis et al. |
| 6,037,319 | A | 3/2000 | Dickler et al. |
| 6,048,830 | A | 4/2000 | Gallon et al. |
| 6,121,215 | A | 9/2000 | Rau |
| 6,183,661 | B1 | 2/2001 | Makin et al. |
| 6,200,949 | B1 | 3/2001 | Reijmer et al. |
| 6,287,550 | B1 | 9/2001 | Trinh |
| 6,410,051 | B1 | 6/2002 | Georg et al. |
| 6,410,500 | B1 | 6/2002 | Haerer et al. |
| 6,468,950 | B1 | 10/2002 | Kawasaki et al. |
| 6,514,429 | B1 | 2/2003 | Waschenbach et al. |
| 6,645,479 | B1 | 11/2003 | Shefer et al. |
| 6,730,646 | B1 | 5/2004 | Waschenbach et al. |
| 7,056,877 | B2 | 6/2006 | Caswell et al. |
| 7,091,171 | B2 | 8/2006 | Caswell et al. |
| 7,119,057 | B2 | 10/2006 | Popplewell et al. |
| 7,125,835 | B2 | 10/2006 | Bennett et al. |
| 7,166,565 | B2 | 1/2007 | Caswell et al. |
| 7,186,680 | B2 | 3/2007 | Caswell et al. |
| 7,196,049 | B2 | 3/2007 | Brian et al. |
| 7,867,968 | B1 | 1/2011 | Aouad |
| 7,871,976 | B1 | 1/2011 | Aouad |
| 8,333,289 | B2 | 12/2012 | Lopez et al. |
| 8,476,219 | B2 | 7/2013 | Aouad |
| 8,579,134 | B2 | 11/2013 | Lopez et al. |
| 9,453,188 | B2 | 9/2016 | Brown et al. |
| 9,453,189 | B2 | 9/2016 | Aouad |
| 2001/0023017 | A1 | 9/2001 | Tararuj et al. |
| 2003/0096730 | A1 | 5/2003 | Perring et al. |
| 2003/0104969 | A1 | 6/2003 | Caswell et al. |
| 2003/0158344 | A1 | 8/2003 | Rodriques et al. |
| 2003/0165692 | A1 | 9/2003 | Koch et al. |
| 2003/0195133 | A1 | 10/2003 | Shefer et al. |
| 2003/0203829 | A1 | 10/2003 | Shefer et al. |
| 2003/0215417 | A1 | 11/2003 | Uchiyama et al. |
| 2003/0216488 | A1 | 11/2003 | Uchiyama et al. |
| 2004/0071746 | A1 | 4/2004 | Popplewell et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2004/0241195 | A1 | 12/2004 | Tollens |
| 2005/0026793 | A1 | 2/2005 | Caswell et al. |
| 2005/0227905 | A1 | 10/2005 | Heinz et al. |
| 2006/0039934 | A1 | 2/2006 | Ness et al. |
| 2007/0054815 | A1* | 3/2007 | Convents ..... C11D 3/386 510/101 |
| 2008/0131695 | A1 | 6/2008 | Aouad et al. |
| 2008/0136055 | A1 | 6/2008 | Cook et al. |
| 2009/0042766 | A1 | 2/2009 | Mayer et al. |
| 2009/0215664 | A1 | 8/2009 | Raehse |
| 2009/0305936 | A1 | 12/2009 | Busch et al. |
| 2010/0115708 | A1 | 5/2010 | Caswell et al. |
| 2010/0278886 | A1 | 11/2010 | Yu et al. |
| 2013/0267454 | A1 | 10/2013 | Aouad |

FOREIGN PATENT DOCUMENTS

| | | | |
|---|---|---|---|
| EP | 0391087 | A1 | 10/1990 |
| EP | 0628627 | A1 | 12/1994 |
| EP | 0812808 | A1 | 12/1997 |
| GB | 2 235 206 | A | 2/1991 |
| JP | 05-168686 | | 7/1993 |
| WO | WO 93/08255 | A1 | 4/1993 |
| WO | WO 94/04656 | | 3/1994 |
| WO | WO 99/09136 | A1 | 2/1999 |
| WO | WO 02/26928 | A1 | 4/2002 |
| WO | WO2004020566 | A1 | 3/2004 |
| WO | WO 2008/009521 | A1 | 1/2008 |

OTHER PUBLICATIONS

Final Office Action for U.S. Appl. No. 14/108,833, dated Jul. 14, 2015, 11 pages.
Notice of Allowance for U.S. Appl. No. 14/108,833, dated May 25, 2016, 7 pages.
Non-Final Office Action for U.S. Appl. No. 12/613,611, dated Mar. 10, 2010, 5 pages.
Notice of Allowance and Fees Due for U.S. Appl. No. 12/732,576, dated Jun. 18, 2010, 10 pages.
Notice of Allowance for U.S. Appl. No. 12/732,576, dated Nov. 2, 2010, 6 pages.
Notice of Allowance for U.S. Appl. No. 12/732,576, dated Dec. 3, 2010, 1 page.
Non-Final Office Action for U.S. Appl. No. 12/749,747, dated Jun. 24, 2010, 8 pages.
Final Office Action for U.S. Appl. No. 12/749,747, dated Oct. 15, 2010, 4 pages.
Notice of Allowance for U.S. Appl. No. 12/749,747, dated Nov. 26, 2010, 6 pages.
Notice of Allowance for U.S. Appl. No. 12/749,747, dated Dec. 9, 2010, 1 page.
Non-Final Office Action for U.S. Appl. No. 13/462,157, dated Nov. 20, 2012, 11 pages.
Notice of Allowance for U.S. Appl. No. 13/462,157, dated Mar. 26, 2013, 10 pages.
Non-Final Office Action for U.S. Appl. No. 13/908,514, dated Jan. 27, 2015, 14 pages.
Final Office Action for U.S. Appl. No. 13/908,514, dated Jul. 2, 2015, 17 pages.
Non-Final Office Action for U.S. Appl. No. 13/908,514, dated Dec. 8, 2015, 17 pages.
Final Office Action for U.S. Appl. No. 13/908,514, dated May 17, 2016, 19 pages.
Preinterview First Office Action for U.S. Appl. No. 14/876,249, dated Mar. 17, 2016, 4 pages.
First Action Interview—Office Action for U.S. Appl. No. 14/876,249, dated Apr. 28, 2016, 3 pages.
Notice of Allowance for U.S. Appl. No. 14/876,249, dated Aug. 17, 2016, 1 page.
International Search Report for International Application Serial No. PCT/US2010/055398, dated Feb. 4, 2011.
International Search Report for International Application Serial No. PCT/US2013/075611, dated Mar. 14, 2014.

* cited by examiner

LAUNDRY SCENT ADDITIVE

This is a continuation of U.S. patent application Ser. No. 14/108,833, filed Dec. 20, 2012, now U.S. Pat. No. 9,453, 188.

FIELD OF THE INVENTION

The present invention relates to products to freshen laundry.

BACKGROUND OF THE INVENTION

There is a segment of consumers that prefer a strong perfume scent to their laundry. These so called "scent seekers" will often over dose laundry products such as laundry detergent and fabric softener to provide the desired freshness to their laundry. Over applying laundry detergent and/or fabric softener can be problematic since these compositions are often precisely designed to deliver a broad selection of benefit agents at certain levels to the wash and the fabric being treated in the wash.

One approach to a fabric treatment composition that can be applied in the wash is to load a water soluble material with unencapsulated and/or encapsulated perfume and provide the scent additive in a particulate form. Ideally, the water soluble material can dissolve quickly in the wash without leaving an unacceptable residue or cause discoloration of the fabric being treated. Depending on the desired consumer product form, water soluble materials having these dissolution properties can be relatively expensive in the context of what consumers are willing to pay to obtain the benefit from the fabric treatment composition and supply of such water soluble materials can be limited.

From the viewpoint of consumers, fabric treatment compositions can suffer from the problem of scent habituation. That is, after a consumer is exposed to the same scent repetitively, the level of scent required so as to be detectable by the consumer may need to be increased. The problem of scent habituation can be overcome by using a greater quantity of fabric treatment composition, which may be undesirable from a consumer perspective due to expense. Another approach to limiting the effects of scent habituation is to provide consumers with multiple scent variants that they can use, which can lessen the potential for scent habituation. Further, not all members of a consumer's household may like the same scent. So, multiple scent variants can allow different people in a household to have garments having different scents.

In view of the above, there is a need to provide a fabric treatment composition to consumers that will provide freshness to their laundry. Such fabric treatment composition desirably is able to be applied by the consumer, independent of other laundry products, to achieve the desired scent level in a cost effective manner and to provide for a variety of scents when desired.

SUMMARY OF THE INVENTION

An embodiment of the invention can be a fabric treatment composition comprising a plurality of pastilles, wherein the pastilles comprise: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; and (c) from about 0.1% to about 12% by weight of the pastilles of friable perfume microcapsule, wherein the friable perfume microcapsule comprises encapsulated perfume.

A further embodiment of the invention can be an array of fabric treatment compositions each member of the array being a fabric treatment composition according to the paragraph immediately preceding this paragraph, wherein the array comprises at least a first fabric treatment composition and a second fabric treatment composition, wherein there is a difference in percentage by weight of polyethylene glycol having a molecular weight from 2,000 to about 13,000 between the pastilles of the first fabric treatment composition and the pastilles of the second fabric treatment composition of less than about 2%.

A further embodiment of the invention can be an array of fabric treatment compositions each member of the array being a fabric treatment composition comprising a plurality of pastilles, wherein the pastilles comprise: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; (c) from about 1% to about 12% by weight of the pastilles unencapsulated perfume; and (d) from about 0.1% to about 12% by weight of the pastilles of friable perfume microcapsule, wherein the friable perfume microcapsule comprises encapsulated perfume; wherein the array comprises at least a first fabric treatment composition and a second fabric treatment composition, wherein there is a difference in percentage by weight of polyethylene glycol having a molecular weight from 2,000 to about 13,000 between the pastilles of the first fabric treatment composition and the pastilles of the second fabric treatment composition of less than about 2%; wherein the pastilles of the first fabric treatment composition have a first unencapsulated perfume and the pastilles of the second fabric treatment composition have a second unencapsulated perfume, wherein the first unencapsulated perfume differs from the second unencapsulated perfume; wherein the pastilles of the first fabric treatment composition and the pastilles of the second fabric treatment composition differ in shape by less than about 2 mm in any dimension; wherein the pastilles of the first fabric treatment composition comprise a first dye and the pastilles of the second fabric treatment composition comprise a second dye, wherein the first dye differs from the second dye; and wherein individual pastilles of the first fabric treatment composition and individual pastilles of the second fabric treatment composition have an individual mass from 0.95 mg to 2 g.

An embodiment of the invention can be a fabric treatment composition comprising a plurality of pastilles, wherein the pastilles comprise: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; and (c) from 0% to about 12% by weight of the pastilles of friable perfume microcapsule, wherein the friable perfume microcapsule comprises encapsulated perfume.

DETAILED DESCRIPTION OF THE INVENTION

Figure 1:
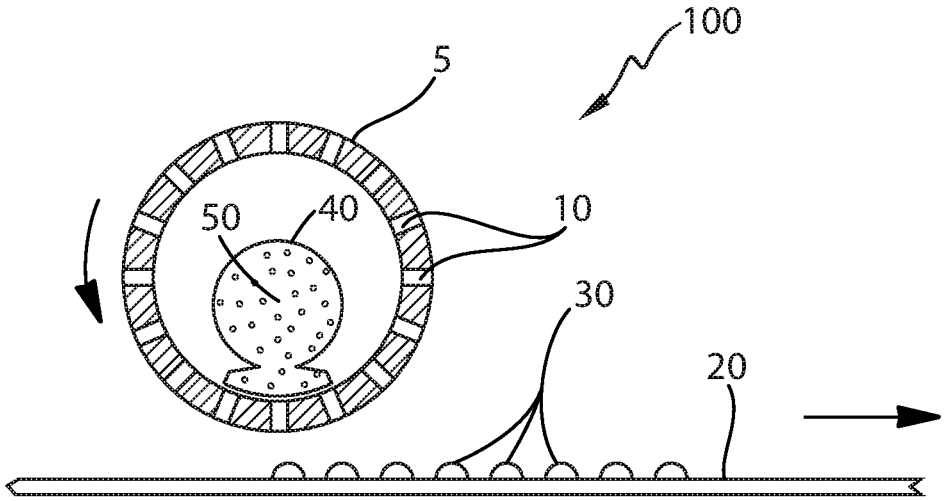
FIG. 1 is a schematic of a pastillation apparatus.

The fabric treatment compositions of the present invention may comprise: a balancing agent; polyethylene glycol; unencapsulated perfume and/or perfume microcapsules; and optionally a dye. In one embodiment, the fabric treatment composition is essentially free of detergent surfactants and/or fabric softening actives.

Polyethylene Glycol (PEG)

Polyethylene glycol (PEG) has a relatively low cost, may be formed into many different shapes and sizes, minimizes unencapsulated perfume diffusion, and dissolves well in water. PEG comes in various molecular weights. A suitable molecular weight range of PEG for the purposes of freshening laundry includes from 2,000 to about 13,000, from about 4,000 to about 12,000, alternatively from about 5,000 to about 11,000, alternatively from about 6,000 to about 10,000, alternatively from about 7,000 to about 9,000, alternatively combinations thereof. PEG is available from BASF, for example PLURIOL E 8000.

The pastilles of the fabric treatment composition of the present invention may comprise from about 65% to about 99% by weight of the pastilles of PEG. Alternatively, the pastilles can comprise from about 80% to about 91%, alternatively from about 86% to about 90%, alternatively from about 85% to about 91%, alternatively more than about 75%, alternatively from about 70% to about 98%, alternatively from about 80% to about 95%, alternatively combinations thereof and any whole percentages or ranges of whole percentages within any of the aforementioned ranges, of PEG by weight of the pastilles.

Balancing Agent

The pastilles of the fabric treatment composition described herein can comprise from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof. The balancing agent can be dipropylene glycol. As used herein, PEG having a molecular weight less than 2,000 is a balancing agent. PEG having a molecular weight from 2,000 to about 13,000 is not a balancing agent. PEG having a molecular weight from 2,000 to about 13,000 is a major component of the pastilles.

The balancing agent for any of the compositions disclosed herein can be selected from the group consisting of isopropyl myristate, dipropylene glycol, and mixtures thereof. Isopropyl myristate can be a suitable balancing agent at a level of about 4% by weight of the pastilles. Isopropyl myristate can be provided with the unencapsulated perfume.

The balancing agent can be polypropylene glycol. The balancing agent can be polypropylene glycol can have molecular weight less than about 400, alternatively less than about 1,000, alternatively less than about 2,000, alternatively less than about 4,000.

It has been found that levels of PEG having a molecular weight from 2,000 to about 13,000 less than about 91% by weight of the pastilles of the fabric treatment composition can be desirable to provide for uniform formation of pastilles of a consumer desirable size via a rotoforming process. Some unencapsulated perfumes and perfume microcapsules have such intense scents that they can be overwhelming to consumers. Thus, for intense unencapsulated perfumes and/or perfume microcapsules, only a limited mass fraction of one or more of those components is needed to deliver the desired scent experience. In view that the desirable level of PEG can be less than 91% by weight of the pastilles, if only a limited mass fraction of one or more of the unencapsulated perfume and/or perfume microcapsules is used, it may not be possible to produce pastilles having the desired size and shape, unless a balancing agent is provided in the composition. If an array of fabric treatment compositions is to be provided, the inability to provide for uniformity amongst the pastilles in the different scent variants across the array can be disconcerting to the consumer. Consumers tend to expect that the products of a single brand within a single category of goods will each have a similar look and feel as well as a similar function and efficacy.

The balancing agent should not interfere with the performance of the pastilles of the composition, for example by altering the scent, color, or the dissolution profile of the pastilles. The balancing agent should also not interfere with the ability of the PMCs to become bound to the fabric being treated. Balancing agents selected from the group consisting of glycerin, polypropylene glycol, isopropyl myristate, dipropylene glycol, 1,2 propanediol, polyethylene glycol having a molecular weight less than 2,000, and mixtures thereof are thought to not interfere with production of and performance of the pastilles of the composition. Since the balancing agent is offsetting having to include additional PEG to form pastilles having the desired size and shape, the balancing agent is desirably less expensive or at least cost-competitive with PEG, compatible with the process used to form the pastilles, easy to employ in the process used to form the pastilles, and readily available for supply in commercially viable quantities.

The balancing agent can also be practical in that it can allow the formulation of an array of fabric treatment compositions comprising pastilles that have similar, if not essentially the same, size, shape, and production characteristics and having a relatively narrow range of PEG levels. Having a narrow range of PEG levels can allow the manufacturer to use a single set of processing conditions to produce pastilles having different levels of unencapsulated perfume and/or encapsulated perfume, with the balance of the formula comprising the balancing agent, accounting for the inclusion of any dyes and/or formula minors.

For example, consider a first fabric treatment composition and a second fabric treatment composition, the pastilles of the first fabric treatment composition having a first unencapsulated perfume and the pastilles of the second fabric treatment composition having a second unencapsulated perfume. If the intensity of the first unencapsulated perfume is greater than the intensity of the second unencapsulated perfume, to have similar scent intensity of the unencapsulated perfume in the pastilles across the array of fabric treatment compositions, a lower level of first encapsulated can be offset with the balancing agent. This will allow the PEG levels for the pastilles of the two compositions to be within a narrow range so that the same manufacturing conditions can be used to produce the pastilles of both, or more, compositions. The balancing agent can be employed in a similar manner if the intensity of the PMCs or both the PMCs and unencapsulated perfumes are different between the pastilles of the compositions.

The pastilles of the fabric treatment compositions described herein can comprise from about 0.5% to about 5% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof. The balancing agent for any of the compositions disclosed herein can be dipropylene glycol. The balancing agent for any of the compositions disclosed herein can be isopropyl myristate.

Unencapsulated Perfume

The pastilles of the fabric treatment composition of the present invention may comprise an unencapsulated perfume and/or a perfume microcapsule. Perfumes are generally described in U.S. Pat. No. 7,186,680 at column 10, line 56, to column 25, line 22. In one embodiment, the pastilles of the fabric treatment composition comprise unencapsulated perfume and are essentially free of perfume carriers, such as a perfume microcapsule. In yet another embodiment, the pastilles of the fabric treatment composition comprise perfume carrier materials (and perfume contained therein). Examples of perfume carrier materials are described in U.S. Pat. No. 7,186,680, column 25, line 23, to column 31, line 7. Specific examples of perfume carrier materials may include cyclodextrin and zeolites.

In the compositions disclosed herein, it is not necessary that the pastilles of the fabric treatment composition comprise unencapsulated perfume. Rather, unencapsulated perfume is an optional component. Embodiments of the pastilles that are substantially free of or free of unencapsulated perfume can be desirable if consumers prefer not to experience a scent when dosing the pastilles of the fabric treatment composition. The scent experience in this arrangement can provided after washing when the perfume microcapsules are deposited on the fabric and after the perfume microcapsules a ruptured otherwise.

In one embodiment, the pastilles of the fabric treatment composition comprise unencapsulated perfume but are free or essentially free of a perfume carrier. In such an embodiment, the pastilles of the fabric treatment composition may comprise less than about 20%, alternatively less than about 25%, alternatively from about 9% to about 20%, alternatively from about 10% to about 18%, alternatively from about 11% to about 13%, alternatively combinations thereof and any whole percentages or ranges of whole percentages within any of the aforementioned ranges, of unencapsulated perfume by weight of the pastilles of the fabric treatment composition.

In one embodiment, the pastilles of the fabric treatment composition can consist essentially of: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; and (c) from about 1% to about 20% by weight of the pastilles of unencapsulated perfume; wherein the pastilles are essentially free of a perfume carrier; and wherein individual pastilles have a mass from 0.95 mg to about 2 g.

In an alternative embodiment, the pastilles of the fabric treatment composition can consist essentially of: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) more than about 75% by weight of the pastilles of polyethylene glycol, wherein the polyethylene glycol has a molecular weight from 2,000 to about 13,000; and (c) less than about 25% by weight of the pastilles of unencapsulated perfume; wherein the pastilles are essentially free of a perfume carrier; and wherein individual pastilles have a mass from 0.95 mg to about 2 g.

In another embodiment, the pastilles can comprise unencapsulated perfume and perfume microcapsules. In this embodiment, the pastilles may comprise from about 1% to about 19%, alternatively from about 1% to about 12%, alternatively from about 2% to about 10%, alternatively from about 3% to about 8%, alternatively from about 4% to about 7%, alternatively from about 5% to about 7%, alternatively combinations thereof and any whole percentages or ranges of whole percentages within any of the aforementioned ranges, of the unencapsulated perfume by weight of the pastilles. Such levels of unencapsulated perfume can be appropriate for any of the embodiments disclosed herein that have unencapsulated perfume.

In yet another embodiment, the pastilles can comprise unencapsulated perfume and a perfume microcapsule but is free or essentially free of other perfume carriers. In yet another embodiment, the pastilles can comprise unencapsulated perfume and a perfume microcapsule and be free of other perfume carriers.

Perfume Microcapsules

The pastilles of the fabric treatment compositions of the present invention can comprise perfume oil encapsulated in a perfume microcapsule (PMC). The PMC can be a friable PMC. The term "PMC" and "perfume microcapsule" are used interchangeably and refers to a plurality of perfume microcapsules.

For purposes of the present invention, the term "perfume microcapsules" or "PMC" describes both perfume microcapsules and perfume nanocapsules. The PMCs can be friable (verses, for example, moisture activated PMCs). The PMCs can be moisture activated.

In one embodiment, the PMC comprises a melamine/formaldehyde shell. Encapsulated perfume and/or PMC may be obtained from Appleton, Quest International, or International Flavor & Fragrances, or other suitable source. In one embodiment, the PMC shell is coated with polymer to enhance the ability of the PMCs to adhere to fabric. The PMCs can be those described in U.S. Patent Pub. 2008/0305982.

In one embodiment, the pastilles can comprise PMCs but be free of or essentially free of unencapsulated perfume. In such an embodiment, the pastilles may comprise less than about 20%, alternatively less than about 25%, alternatively from about 0.1% to about 12%, alternatively from about 0.5% to about 12%, alternatively from about 0.5% to about 20%, alternatively from about 0% to about 12%, alternatively from about 1% to about 15%, alternatively from about 1% to about 12%, alternatively from about 2% to about 10%, alternatively combinations thereof and any whole percentages or ranges of whole percentages within any of the aforementioned ranges, of PMC (including the encapsulated perfume) by weight of the pastilles. In such an embodiment, the perfume encapsulated by the PMC may comprise from about 0.1% to about 4% of perfume by weight of the pastilles.

Dye

The pastilles may comprise dye. The dye may include those dyes that are typically used in laundry detergent or fabric softeners. The fabric treatment composition may comprises from about 0.001% to about 0.1%, alternatively from about 0.01% to about 0.02%, alternatively combinations thereof and any whole percentages or ranges of whole percentages within any of the aforementioned ranges, of dye by weight of the fabric treatment composition. Examples of suitable dyes include, but are not limited to, LIQUITINT PINK AM, AQUA AS CYAN 15, and VIOLET FL, available from Milliken Chemical.

Free of Laundry Actives and Softeners

The fabric treatment composition may be free of laundry active and/or fabric softener actives. The pastilles of the fabric treatment composition may be free of laundry active and/or fabric softener actives. To reduce costs and avoid formulation compatibility issues, one aspect of the invention may include pastilles that are free or essentially free of laundry actives and/or fabric softener actives. In one embodiment, the pastilles comprise less than about 3% by weight of the pastilles, alternatively less than about 2% by weight of the pastilles, alternatively less than about 1% by weight of the pastilles, alternatively less than about 0.1% by weight of the pastilles, alternatively are about free, of laundry actives and/or fabric softener actives (or combinations thereof). A laundry active includes: detergent surfactants, detergent builders, bleaching agents, enzymes, mixtures thereof, and the like. It is appreciated that a non-detersive level of surfactant may be used to help solubilize perfume contained in the pastilles.

Fabric Treatment Compositions

In one embodiment, the pastilles can consist essentially of: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; and (c) from about 0% or even about 0.1% or even about 1% to about 20% by weight of the pastilles of a friable perfume microcapsule, wherein the perfume microcapsule comprises encapsulated perfume; wherein the pastilles are essentially free of unencapsulated perfume; and wherein individual pastilles have a mass from 0.95 mg to about 2 g. In such an embodiment, the perfume encapsulated by the PMC may comprise from about 0.1% to about 4% of perfume by weight of the pastilles.

In another embodiment, the pastilles comprise PMC and unencapsulated perfume. In such an embodiment, the pastilles may comprise from 0% to about 10%, alternatively from about 0.1% to about 10%, alternatively about 1% to about 10%, alternatively from 0% to about 12%, alternatively from about 0.1% to about 12%, alternatively about 1% to about 12%, alternatively from about 2% to about 8%, alternatively from about 3% to about 8%, alternatively from about 4% to about 7%, alternatively from about 5% to about 7%, alternatively combinations thereof and any whole percentages or ranges of whole percentages within any of the aforementioned ranges, of PMC (including the encapsulated perfume) by weight of the pastilles. In this embodiment, the perfume encapsulated by the PMC may comprise from about 0.1% to about 4% of perfume by weight of the pastilles.

In one embodiment, the pastilles may consist essentially of: (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; (c) from about 1% to about 12% by weight of the pastilles unencapsulated perfume; and (d) from 0% to about 12%, or alternatively from about 0.1% to about 12%, or alternatively from about 1% to about 12%, by weight of the pastilles of friable perfume microcapsule, wherein the perfume microcapsule comprises encapsulated perfume; wherein individual pastilles have a mass from 0.95 mg to about 2 g. In this embodiment, the perfume encapsulated by the PMC may comprise from about 0.1% to about 4% of perfume by weight of the pastilles.

In one embodiment, the pastilles comprise (a) from about 0.1% to about 10% by weight of the pastilles of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles of polyethylene glycol, wherein the polyethylene glycol has a molecular weight from 2,000 to about 13,000; (c) from about 1% to about 12% by weight of the pastilles of unencapsulated perfume; and (d) from 0% to about 12%, or alternatively from about 0.1% to about 12%, alternatively from about 0.5% to about 12%, or alternatively about 1% to about 12% by weight of the pastilles of a friable perfume microcapsule, wherein the perfume microcapsule comprises encapsulated perfume; and wherein individual pastilles have a mass from about 0.95 mg to about 2 g.

Such a formulation is thought to provide for a balanced scent experience to the user of the fabric treatment composition. With the level of polyethylene glycol between about 80% and about 91% by weight of the pastilles, the about 1% to about 12% by weight of the pastilles of unencapsulated perfume can provide for a pleasant scent experience to the user upon opening of the package containing the pastilles and as the user pours the pastilles into a dosing device and transfers the pastilles to her washing machine. That is the user can experience the scent at an appreciably detectable level but she is not overwhelmed by the scent. Similarly, the about 0.1% to about 12%, or alternatively about 0.5% to about 12%, or alternatively about 1% to about 12% by weight of the pastilles of friable perfume microcapsule can provide physical and/or chemical stability of the pastille and for a sufficient quantity of friable perfume microcapsule to deposit on a user's clothing during washing when the pastilles are applied in the wash. Further, it can be beneficial for the pastilles to consist essentially of the above ingredients at the prescribed levels as additional components might interfere with the physical and/or chemical stability of the pastilles and recognizing that other components, such as surfactants, fabric softeners, or other such ingredients, might be delivered by other mechanisms, such as the detergent or dryer added product, and there would be the potential that the user might over apply such ingredients during washing and/or drying.

In yet another embodiment, the pastilles can comprise perfume microcapsule but be free or essentially free of other perfume carriers and/or unencapsulated perfume. In yet still another embodiment, the pastilles may comprise a formaldehyde scavenger. In yet still another embodiment, the scent of the pastilles is coordinated with scent(s) of other fabric care products (e.g., laundry detergent, fabric softener). This way, consumers who like APRIL FRESH scent, may use a pastille having an APRIL FRESH scent, thereby coordinating the scent experience of washing their laundry with their scent experience from using APRIL FRESH. The pastilles of the present invention may be sold as a product array (with laundry detergent and/or fabric softener) having coordinated scents.

Pastilles

Pastilles may be formed by those methods known in the art, including methods disclosed in U.S. Pat. Nos. 5,013,498 and 5,770,235. The melt of the pastilles of the present invention may be prepared in either batch or continuous mode. In batch mode, molten PEG is loaded into a mixing vessel having temperature control. PMC is then added and mixed with PEG until homogeneous. Unencapsulated perfume is then added to the vessel and the components are further mixed for a period of time until the entire mixture is homogeneous. In continuous mode, molten PEG is mixed with unencapsulated perfume and PMC in an in-line mixer such as a static mixer or a high shear mixer and the resulting homogeneous mixture is then used for pastillation. PMC and unencapsulated perfume can be added to PEG in any order or simultaneously and dye can be added at a step prior to pastillation.

The pastilles may be formed into different shapes include tablets, pills, spheres, and the like. A pastille can have a shape selected from the group consisting of spherical, hemispherical, compressed hemispherical, lentil shaped, and oblong. Lentil shaped refers to the shape of a lentil bean. Compressed hemispherical refers to a shape corresponding to a hemisphere that is at least partially flattened such that the curvature of the curved surface is less, on average, than the curvature of a hemisphere having the same radius. A compressed hemispherical pastille can have a ratio of height to diameter of from about 0.01 to about 0.4, alternatively from about 0.1 to about 0.4, alternatively from about 0.2 to about 0.3. Oblong shaped refers to a shape having a maximum dimension and a maximum secondary dimension orthogonal to the maximum dimension, wherein the ratio of maximum dimension to the maximum secondary dimension is greater than about 1.2. An oblong shape can have a ratio of maximum dimension to maximum secondary dimension greater than about 1.5. An oblong shape can have a ratio of maximum dimension to maximum secondary dimension greater than about 2. Oblong shaped particles can have a maximum dimension from about 2 mm to about 6 mm, a maximum secondary dimension of from about 2 mm to about 4 mm.

In alternative embodiments of any of the formulations disclosed herein, individual pastilles can have a mass from about 0.95 mg to about 2 g, alternatively from about 10 mg to about 1 g, alternatively from about 10 mg to about 500 mg, alternatively from about 10 mg to about 250 mg, alternatively from about 0.95 mg to about 125 mg, alternatively combinations thereof and any whole numbers or ranges of whole numbers of mg within any of the aforementioned ranges. In a plurality of pastilles, individual pastilles can have a shape selected from the group consisting of spherical, hemispherical, compressed hemispherical, lentil shaped, and oblong.

An individual pastille may have a volume from about 0.003 $cm^3$ to about 0.15 $cm^3$. A plurality of pastilles may collectively comprise a dose for dosing to a laundry washing machine or laundry wash basin. A single dose of the pastilles may comprise from about 1 g to about 27 g.

A single dose of the pastilles may comprise from about 5 g to about 27 g, alternatively from about 13 g to about 27 g, alternatively from about 14 g to about 20 g, alternatively from about 15 g to about 19 g, alternatively from about 18 g to about 19 g, alternatively combinations thereof and any whole numbers of grams or ranges of whole numbers of grams within any of the aforementioned ranges. The individual pastilles forming the plurality of pastilles that can make up the dose can have a mass from about 0.95 mg to about 2 g. The plurality of pastilles can be made up of pastilles of different size, shape, and/or mass. The pastilles in a unit dose can have a maximum dimension less than about 1 centimeter.

The pastilles may be manufactured by a pastillation process. A schematic of a pastillation apparatus 100 is illustrated in FIG. 1. The steps of manufacturing according to such process can comprise providing the desired formulation as a viscous material 50. The viscous material 50 can comprise or consists of any of the embodiments of formulations disclosed herein. In one embodiment, the viscous material 50 comprises: (a) from about 0.1% to about 10% by weight of the viscous material of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the viscous material of polyethylene glycol, wherein the polyethylene glycol has a molecular weight from 2,000 to about 13,000; (c) from about 0% to about 12% by weight of the viscous material of unencapsulated perfume, alternatively from about 1% to about 12% by weight of the viscous material of unencapsulated perfume; and (d) from 0% to about 12 by weight of the viscous material of friable perfume microcapsule, alternatively from about 0.1% to about 12% of the viscous material of friable perfume microcapsule, alternatively from about 0.5% to about 12% of the viscous material of friable perfume microcapsule, alternatively from about 0.5% to about 12% of the viscous material of friable perfume microcapsule, wherein the perfume microcapsule comprises encapsulated perfume. The viscous material 50 can be provided at a processing temperature less than about 20 degrees Celsius above the onset of solidification temperature as determined by differential scanning calorimetry.

In one embodiment, the PMC can be added as a slurry to the polyethylene glycol and unencapsulated perfume to form the viscous material 50. The PMC can be added as a powder to the polyethylene glycol and unencapsulated perfume to form the viscous material 50. The viscous material 50 can be passed through small openings 10 and onto a moving conveyor surface 20 upon which the viscous material 50 is cooled below the glass transition temperature to form a plurality of pastilles 30. As illustrated in FIG. 1, the small openings 10 can be on a rotatable pastillation roll 5. Viscous material 50 can be distributed to the small openings 10 by a viscous material distributor 40. Pastilles can be formed on a ROTOFORMER, available from Sandvik Materials Technology.

Array of Fabric Treatment Compositions

Figure 2:
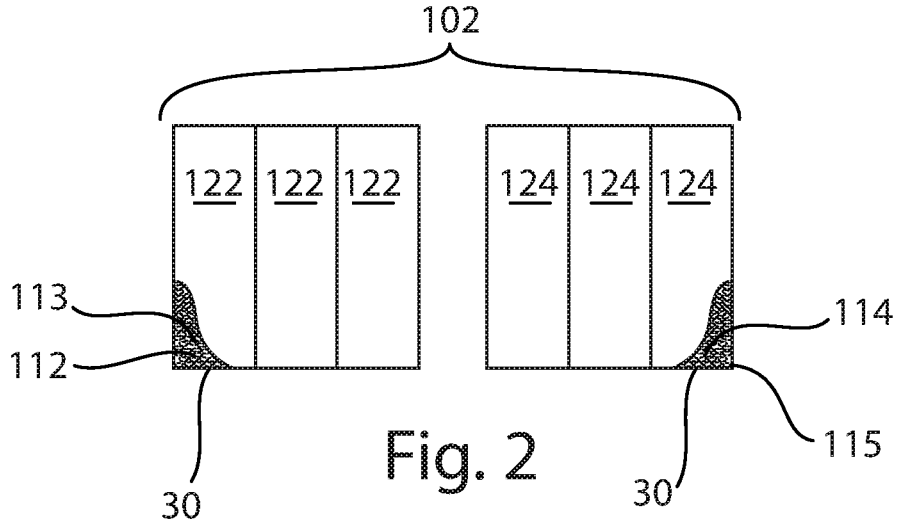
FIG. 2 is a schematic of an array of fabric treatment compositions.

The fabric treatment compositions presented herein can be provided in an array 102 of fabric treatment compositions 110, as shown in FIG. 2. The array 102 can comprise at lease a first fabric treatment composition 112 and a second fabric treatment composition 114. The first fabric treatment composition 112 and the second fabric treatment composition 114 can comprise pastilles 30. There can be a difference in percentage by weight of polyethylene glycol having a molecular weight from 2,000 to about 13,000 between the pastilles 30 of the first fabric treatment composition 112 and the pastilles 30 of the second fabric treatment composition 114 of less than about 2%, by weight of the pastilles. Alternatively, the difference in percentage by weight of polyethylene glycol having a molecular weight from 2,000 to about 13,000 between the pastilles 30 of the first fabric treatment composition 112 and the pastilles 30 of the second fabric treatment composition 114 can be less than about 1%, or even less than about 0.5%, or even less than about 0.2%, by weight of the pastilles.

The array 102 can be presented to a consumer on a shelf, product display, or other arrangement suitable for presenting products to a consumer in a retail environment. The array can be, by way of non-limiting example, a plurality of fabric treatment compositions 110 each of which have a different scent. For instance, the first fabric treatment composition 112 can be contained in a first package 122 and the second fabric treatment composition 114 can be contained in a second package 124. The first fabric treatment composition 112 and the second fabric treatment composition 114 can be less than about 1 m apart from one another, or alternatively less than about 0.6 m from one another, or alternatively less than about 0.5 m from one another, or alternatively less than about 0.15 m from one another.

The pastilles 30 of the first fabric treatment composition 112 can have a first unencapsulated perfume and the pastilles 30 of the second fabric treatment composition 114 can have a second unencapsulated perfume, wherein the first unencapsulated perfume differs from the second unencapsulated perfume. For instance, the pastilles 30 of the first fabric treatment composition 112 can have kiwi scented unencapsulated perfume and the pastilles 30 of the second fabric treatment composition 114 can have lavender scented unencapsulated perfume. For the pastilles 30 of each of these fabric treatment compositions, the difference in percentage by weight of polyethylene glycol having a molecular weight from 2,000 to about 13,000 between the pastilles 30 of the first fabric treatment composition 112 and the pastilles 30 of the second fabric treatment composition 114 can be less than about 2%. Formulated as such, the manufacturer can produce the pastilles 30 of the first fabric treatment composition 112 and the pastilles 30 of the second fabric treatment composition 114 using the same processing conditions. This can increase production capacity and reliability of the manufacture of the pastilles 30 of the compositions since the operators do not have to spend time adjusting the processing conditions to make pastilles 30 that have different unencapsulated perfumes and can reduce the potential for errors in setting the processing conditions.

A further benefit of using a narrow range of levels of polyethylene glycol is that the pastilles 30 of the first fabric treatment composition 112 can have the same shape as the pastilles 30 of the second fabric treatment composition 114. The same shape can be achieved using the same processing conditions for the pastilles 30 of the first fabric treatment composition 112 and the pastilles 30 of the second fabric treatment composition 114. It can be desirable for manufacturers to provide multiple different scented fabric treatment compositions that have the same shape of pastilles 30 to simplify product handling during manufacture, distribution, and use. Further, consistency in shape of the pastilles 30 across different scent variants can be desirable since the shape can affect dissolution of the composition in the wash and it can be desirable to have the same dissolution profile of the pastilles 30 across the array of fabric treatment compositions. The pastilles 30 of the first fabric treatment composition 112 and the pastilles 30 of the second fabric treatment composition 114 can differ in shape by less than about 2 mm in any dimension. Without being bound by theory, it is thought that having such a small difference in shape can result in an insignificant difference in dissolution profile in the wash under normal use conditions. Further, such a small difference in shape may not be readily recognizable by consumers. The pastilles 30 of the first fabric treatment composition 112 and the pastilles 30 of the second fabric treatment composition 114 can differ in shape by less than about 1 mm in any dimension.

In the same manner and achieving a similar benefit, the pastilles 30 of the first fabric treatment composition 112 can have a first encapsulated perfume and the pastilles 30 of the second fabric treatment composition 114 can have a second encapsulated perfume, wherein the first encapsulated perfume differs from the second encapsulated perfume. This approach can allow the manufacturer to easily provide pastilles 30 for two or more fabric treatment compositions having different encapsulated perfumes. This can be desirable for providing a different scent experience to the consumer as she wears her garment depending on whether she used the first fabric treatment composition 112 or the second fabric treatment composition 114.

It may also be desirable to provide pastilles 30 of the first fabric treatment composition 112 that have a first dye and pastilles 30 of the second fabric treatment composition 114 that have a second dye, wherein the first dye differs from the second dye. That can be desirable for providing pastilles 30 for the fabric treatment compositions in different color variants. In one embodiment, it can be practical to have different colors denote different scents, the different scents being provided by one or both of the unencapsulated perfume and the encapsulated perfume that differ from one another.

In considering the array 102, the pastilles 30 of the first fabric treatment composition 112 can be first pastilles 113 and the pastilles of the second fabric treatment composition 114 can be second pastilles 115. Thus, for the embodiments disclosed herein, the array 102 can comprise at least a first fabric treatment composition 112 comprising first pastilles 113 and a second fabric treatment composition comprising second pastilles 115. The first pastilles 113 can be any of the embodiments of pastilles 30 disclosed herein. Similarly, the second pastilles 115 can be any of the embodiments of pastilles 30 disclosed herein.

Figure 3:
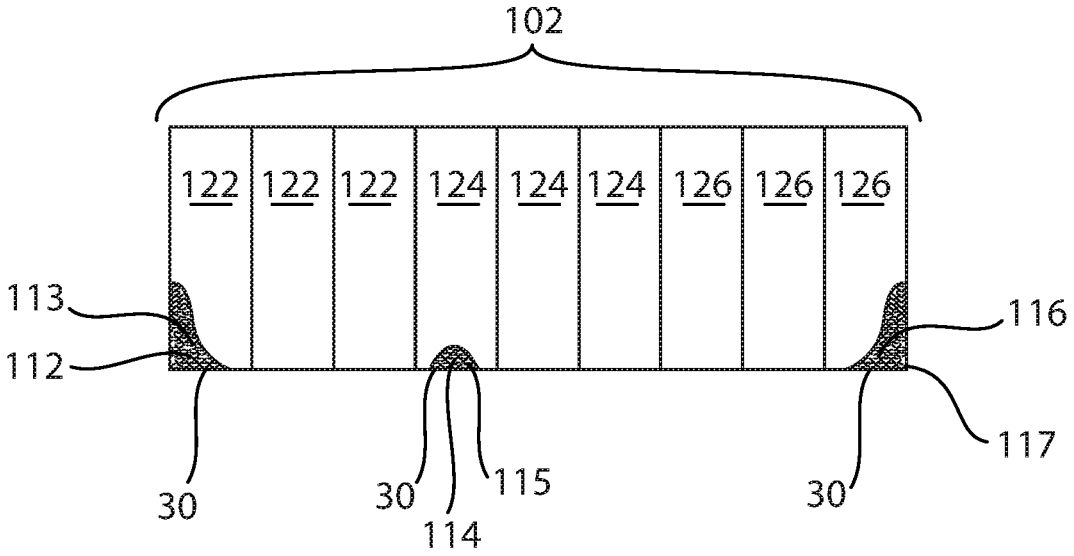
FIG. 3 is a schematic of an array of fabric treatment compositions.

The array 102 can comprise at least a first fabric treatment composition 112 contained in a first package 122, a second fabric treatment composition 114 contained in a second package 124, and a third fabric treatment composition 116 contained in a third package 126, as shown in FIG. 3. The pastilles 30 of the third fabric treatment composition 116 can be third pastilles 117, with such third pastilles 117 being any of the embodiments of pastilles 30 disclosed herein. As shown in FIGS. 2 and 3 the packages can be arranged to be proximal to one another. As shown in FIG. 3 the packages can be arranged to be next to one another. It is possible, for instance, for the packages to be grouped by the scent of the encapsulated and/or unencapsulated perfume. The array 102 can be presented on a shelf or group of shelves to a consumer.

Package

A single dose or a plurality of doses may be contained in a package. The package may be a bottle, bag, or other container. In one embodiment, the package is a bottle, for instance a PET bottle comprising a translucent portion to showcase the pastilles 30 to a viewing consumer. In one embodiment, the package comprises a single dose (e.g., trial size sachet); or multiple doses (e.g., from about 15 doses to about 100 doses).

Dosing

The aforementioned package may comprise a dosing means for dispensing the fabric treatment composition from the package to a laundry washing machine (or laundry wash basin in hand washing applications). The user may use the dosing means to meter the recommended dose amount or simply use the dosing means to meter the fabric treatment composition according to the user's own scent preference. Examples of a dosing means may be a dispensing cap, dome, or the like, that is functionally attached to the package. The dosing means can be releasably detachable from the package and re-attachable to the package, such as for example, a cup mountable on the package. The dosing means may be tethered (e.g., by hinge or string) to the rest of the package (or alternatively un-tethered). The dosing means may have one or more demarcations (e.g., fill-line) to indicate a recommend dose amount. The packaging may include instructions instructing the user to open the removable opening of the package, and dispense (e.g., pour) the fabric treatment composition contained in the package into the dosing means. Thereafter, the user may be instructed to dose the pastilles 30 contained in the dosing means to a laundry washing machine or laundry wash basin. The pastilles 30 disclosed herein may be used to add freshness to laundry. The package including the dosing means may be made of plastic.

One embodiment can be a dose of a fabric treatment composition comprising a plurality of pastilles 30, wherein the pastilles 30 comprise: (a) from about 0.1% to about 10% by weight of the pastilles 30 of a balancing agent selected from the group consisting of glycerin, polypropylene glycol, isopropyl myristate, dipropylene glycol, 1,2 propanediol, polyethylene glycol having a molecular weight less than 2,000, and mixtures thereof; (b) from about 80% to about 91% by weight of the pastilles 30 of polyethylene glycol, wherein the polyethylene glycol has a molecular weight from 2,000 to about 13,000; (c) from about 0% to about 12% by weight of the pastilles 30 of unencapsulated perfume, alternatively from about 0.1% to about 12% by weight of the pastilles 30 of unencapsulated perfume, alternatively from about 1% to about 12% by weight of the pastilles 30 of unencapsulated perfume; and (d) from about 1% to about 12% by weight of the pastilles 30 of friable perfume microcapsule, wherein the perfume microcapsule comprises encapsulated perfume; wherein said pastilles 30 each have an individual mass from about 0.95 mg to 2 g; and wherein the plurality of pastilles has a mass from about 1 g to about 27 g to comprise the dose. The dose can be about 19 g.

In one embodiment, the pastilles 30 of the present invention can be administered to a laundry machine as used during the "wash cycle" of the washing machine (but a "rinse cycle" may also be used). In another embodiment, the pastilles 30 of the present invention are administered in a laundry wash basin—during washing and/or rinsing laundry. In a laundry hand rinsing application, the pastille may further comprise an "antifoam agent" such as those available from Wacker.

Example fabric treatment compositions are listed in the following table. The friable perfume microcapsules can have a melamine formaldehyde shell and be of the type manufactured by Appleton. The dye can be LIQUITINT dyes manufactured by Milliken.

EXAMPLES

| Ingredient | Composition 1 % By Weight | Composition 2 % By Weight | Composition 3 % By Weight |
|---|---|---|---|
| PEG 8000 | 87.375 | 87.370 | 87.376 |
| Dipropylene Glycol | 4.300 | 1.080 | 3.110 |
| Unencapsulated Perfume | 4.920 | 7.500 | 6.000 |
| Friable Perfume Microcapsules | 3.390 | 4.040 | 3.500 |
| Dye | 0.015 | 0.010 | 0.014 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of fabric treatment compositions each member of said array being a fabric treatment composition comprising a plurality of pastilles, wherein said pastilles comprise:

(a) from about 0.1% to about 10% by weight of said pastilles of a balancing agent selected from the group consisting of glycerin, polypropylene glycol, isopropyl myristate, dipropylene glycol, 1,2 propanediol, and mixtures thereof;

(b) polyethylene glycol; and (c) from about 0.1% to about 12% by weight of said pastilles of friable perfume microcapsule, wherein said friable perfume microcapsule comprises encapsulated perfume;

wherein said array comprises at least a first fabric treatment composition and a second fabric treatment composition, wherein there is a difference in percentage by weight of polyethylene glycol between said pastilles of said first fabric treatment composition and said pastilles of said second fabric treatment composition of less than about 2%;

wherein said pastilles of said first fabric treatment composition have a first encapsulated perfume and said pastilles of said second fabric treatment composition have a second encapsulated perfume, wherein said first encapsulated perfume differs from said second encapsulated perfume.

2. The array according to claim 1, wherein said pastilles comprise from about 1% to about 12% by weight of said pastilles unencapsulated perfume.

3. The array according to claim 2, wherein said balancing agent is selected from the group consisting of isopropyl myristate, dipropylene glycol, and mixtures thereof.

4. The array according to claim 3, wherein said pastilles comprise from about 0.5% to about 5% by weight of said pastilles of said balancing agent.

5. The array according to claim 1, wherein said plurality of pastilles includes individual pastilles having a shape selected from the group consisting of spherical, hemispherical, compressed hemispherical, lentil shaped, and oblong.

6. The array according to claim 1, wherein individual pastilles have a mass from 0.95 mg to 2 g.

7. The array according to claim 1, wherein said pastilles of said first fabric treatment composition comprises from about 1% to about 12% by weight of said first fabric treatment composition unencapsulated perfume and said pastilles of said second fabric treatment composition comprise from about 1% to about 12% by weight of said second fabric treatment composition unencapsulated perfume.

8. The array according to claim 7, wherein said difference in percentage by weight of polyethylene glycol between said pastilles of said first fabric treatment composition and said pastilles of said second fabric treatment composition is less than about 1%.

9. The array according to claim 7, wherein said balancing agent is selected from the group consisting of isopropyl myristate, dipropylene glycol, and mixtures thereof.

10. The array according to claim 1, wherein said first fabric treatment composition is contained in a first package and said second fabric treatment composition is contained in a second package.

11. The array according to claim 10, wherein said first fabric treatment composition and said second treatment composition are less than about 1 m apart from one another.

12. The array according to claim 1, wherein said pastilles of said first fabric treatment composition have the same shape as said pastilles of said second fabric treatment composition.

13. The array according to claim 12, wherein said pastilles of said first fabric treatment composition and said pastilles of said second fabric treatment composition differ in shape by less than about 2 mm in any dimension.

14. The array according to claim 1, wherein pastilles of said first fabric treatment composition comprise a first dye and said pastilles of said second fabric treatment composition comprise a second dye, wherein said first dye differs from said second dye.

15. An array of fabric treatment compositions each member of said array being a fabric treatment composition comprising a plurality of pastilles, wherein said pastilles comprise:

(a) from about 0.1% to about 10% by weight of said pastilles of a balancing agent selected from the group consisting of glycerin, polypropylene glycol, isopropyl myristate, dipropylene glycol, 1,2 propanediol, and mixtures thereof;

(b) polyethylene glycol; and (c) from about 0.1% to about 12% by weight of said pastilles of friable perfume microcapsule, wherein said friable perfume microcapsule comprises encapsulated perfume;

wherein said array comprises at least a first fabric treatment composition and a second fabric treatment composition, wherein there is a difference in percentage by weight of polyethylene glycol between said pastilles of said first fabric treatment composition and said pastilles of said second fabric treatment composition of less than about 2%;

wherein said pastilles of said first fabric treatment composition have a first encapsulated perfume and said pastilles of said second fabric treatment composition have a second encapsulated perfume, wherein said first encapsulated perfume differs from said second encapsulated perfume;

wherein said pastilles of said first fabric treatment composition and said pastilles of said second fabric treatment composition differ in shape by less than about 2 mm in any dimension;

wherein said pastilles of said first fabric treatment composition comprise a first dye and said pastilles of said second fabric treatment composition comprise a second dye, wherein said first dye differs from said second dye; and wherein individual pastilles of said first fabric treatment composition and individual pastilles of said second fabric treatment composition have an individual mass from 0.95 mg to 2 g.

16. An array of fabric treatment compositions each member of said array being a fabric treatment composition comprising a plurality of pastilles, wherein said pastilles comprise:

(a) from about 0.1% to about 10% by weight of said pastilles of a balancing agent selected from the group consisting of glycerin, polypropylene glycol, isopropyl myristate, dipropylene glycol, 1,2 propanediol, and mixtures thereof;

(b) polyethylene glycol; and (c) from about 0.1% to about 12% by weight of said pastilles of perfume;

wherein said array comprises at least a first fabric treatment composition and a second fabric treatment composition, wherein there is a difference in percentage by weight of polyethylene glycol between said pastilles of said first fabric treatment composition and said pastilles of said second fabric treatment composition of less than about 2%;

wherein said pastilles of said first fabric treatment composition have a first unencapsulated perfume and said pastilles of said second fabric treatment composition have a second unencapsulated perfume, wherein said first unencapsulated perfume differs from said second unencapsulated perfume; and wherein individual pastilles have a mass from 0.95 mg to 2 g.

17. The array according to claim 16, wherein said first fabric treatment composition is contained in a first package and said second fabric treatment composition is contained in a second package.

18. The array according to claim 17, wherein pastilles of said first fabric treatment composition comprise a first dye and said pastilles of said second fabric treatment composition comprise a second dye, wherein said first dye differs from said second dye.

19. The array according to claim 18, wherein said balancing agent is selected from the group consisting of isopropyl myristate, dipropylene glycol, and mixtures thereof.

* * * * *